United States Patent [19]

Grinde

[11] Patent Number: 4,947,779

[45] Date of Patent: Aug. 14, 1990

[54] WATERCRAFT TOW BAR

[76] Inventor: James E. Grinde, 2401 - 147th Ln. N.E., Anoka, Minn. 55303

[21] Appl. No.: 345,974

[22] Filed: May 1, 1989

[51] Int. Cl.[5] ..... B63B 21/58

[52] U.S. Cl. ..... 114/250; 280/414.1; 280/483

[58] Field of Search ..... 114/230, 242–250; 280/292, 414.1, 416.3, 483, 493, 504

[56] References Cited

U.S. PATENT DOCUMENTS

| | | | |
|---|---|---|---|
| 2,738,525 | 3/1956 | Roberts | 114/250 |
| 3,428,332 | 2/1969 | McCance | 280/292 |
| 4,276,850 | 7/1981 | Valencia | 114/230 |

FOREIGN PATENT DOCUMENTS

| | | | |
|---|---|---|---|
| 43889 | 2/1988 | Japan | 114/250 |

*Primary Examiner*—Joseph F. Peters, Jr.
*Assistant Examiner*—Jesûs D. Sotelo
*Attorney, Agent, or Firm*—Haugen and Nikolai

[57] ABSTRACT

The specification describes a tow bar assembly for coupling an auxiliary watercraft to the stern of a larger towing craft. The tow bar assembly comprises a socket member especially designed for attachment to the swim platform of the towing craft when one is provided or, alternatively, directly to the transom of the towing craft. The socket is designed to receive one end of a generally longitudinally incompressible but vertically flexible bar member. The other end of the bar member is provided with a suitable coupling device for facilitating connection to the bow of the craft to be towed.

18 Claims, 2 Drawing Sheets

WATERCRAFT TOW BAR

BACKGROUND OF THE INVENTION

I. Field of the Invention

This invention relates generally to apparatus for facilitating the transportation of an auxiliary watercraft along with a larger boat, and more particularly to an improved tow bar assembly for coupling the auxiliary marine craft to the stern portion of a larger watercraft to permit the small craft to be towed.

II. Discussion of the Prior Art

Boating on our nation's lakes, rivers and coastal areas has become an exceedingly popular pastime. Powercraft, such as cruisers and houseboats most often exceed 30 feet in length and usually have accommodations for living on board, including a galley, sleeping areas, a head, etc. Many boaters find it enjoyable to cruise to a favorite area, beach the boat or anchor out and spend weekends or longer intervals living on the boat.

Because of the size and fuel cost considerations, these larger craft owners would prefer to take along and use a smaller, auxiliary outboard motor powered boat, such as the popular Boston Whaler® or a variety of inflatable craft. These auxiliary craft are typically about 11–16 ft. in length. This small craft can then be used to run errands, pull water skiers or to take short trips where the boat owner does not wish to use his larger cruiser/houseboat-type watercraft.

Also, there are a number of recreational watercrafts which are gaining popularity. In this category are the Yamaha Waverunner® and the Kawasaki Jet Ski®. A cruiser or houseboat owner who also owns one of these motorized "water toys" will often want to take it along for use on weekend outings.

For cruisers and houseboats ranging in length from about 28 feet to, say, 42 feet, deck space is at a premium. There is a real need for a means for transporting the auxiliary, smaller-sized watercraft of the type indicated. With boats larger than about, say, 42 feet, there will usually be enough deck space on which the smaller crafts can be carried. Thus, those larger watercraft can be equipped with davits or lift booms for lifting the smaller craft and selectively depositing it on available deck space or, alternatively, taking it from the deck space and setting it in the water. Such davits/lift booms are relatively expensive. Moreover, a problem still remains as to how smaller-sized cruisers and houseboats can readily transport an auxiliary boat or water toy.

Attempts have been made to tow the smaller-sized craft behind the cruiser/houseboat using ropes to join the two. This technique is less than satisfactory in that the towed craft tends to wander back and forth behind the towing craft due to the wake generated by the towing craft or due to waves produced by passing boats. Also, the use of ropes has presented difficulty when stopping or maneuvering in that the inertia of the towed craft may close the gap between it and the towing craft to the point where the rope may loop down and become fouled with the towing craft's propellers. Backing, of course, compounds this problem.

OBJECTS

It is accordingly a principal object of the present invention to provide an improved means for transporting a small power boat, inflatable craft or personal water vehicle along with a larger size cruiser or houseboat.

Another object of the invention is to provide a towing mechanism for rigidly joining a towing craft to a towed craft in a fashion that the towed craft can still rise and fall with wave action and wake of the towing craft.

Yet another object of the invention is to provide a tow bar mechanism which is easy to install generally hidden from view and, therefore, unobtrusive, yet easy to use.

A yet further object of the invention is to provide a towing mechanism for joining a smaller craft to a larger craft and which permits backing, turning and docking of the larger craft without fear of lines becoming entangled with the propellers or possible danger to a person at the stern of the towing craft that tries to prevent collisions.

SUMMARY OF THE INVENTION

The foregoing features, objects and advantages of the invention are achieved by providing a tow bar mechanism including a tubular socket of generally rectangular cross-section which may alternatively be attached either to the transom or to the underside of the swim platform of the towing craft, where one is present. The socket includes a latch-pin receiving aperture passing vertically through it. An elongated, longitudinally incompressible, but vertically resilient, bar member approximately 4 feet in length, having a reinforced forward end and a clevis connection attached to its other end is also part of the assembly. The clevis connection facilitates coupling the second end of the bar to the bow of the towed craft. In the case of a conventional boat, it may connect to the bow eye, and on a personal watercraft, the clevis may attach to an adaptor specially designed to allow easy attachment. When the forward end of the bar is inserted into the socket, a latch pin may be dropped through the aligned apertures in each to secure it in place. The width dimension of the tow bar is approximately the same as the width dimension of the opening in the socket and, as such, lateral shifting of the bar and towed craft is precluded. Because the bar member is flexible in a vertical plane, the towed craft may rise and fall with the wake and the spring constant of the tow bar tends to load the front end of the towed craft to maintain its bow generally level even when traversing waves.

The tow bar is also provided with a floatation device to prevent its sinking if it inadvertently falls out of the grasp of the user when being installed between the towing and towed craft.

DESCRIPTION OF THE PREFERRED EMBODIMENT

Figure 1:
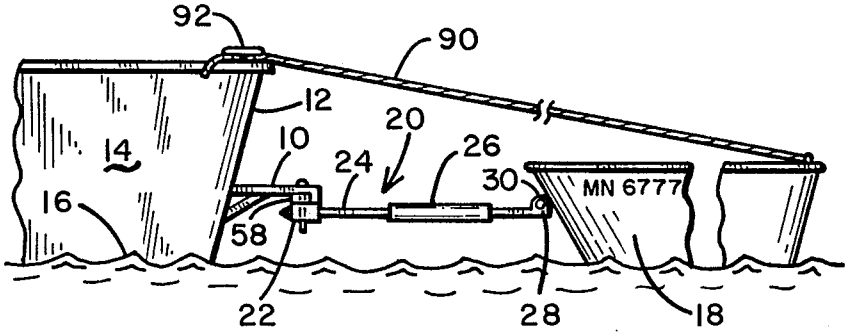
FIG. 1 is a partial side elevation view of an auxiliary, personal watercraft being towed by a larger marine craft where the towing assembly is coupled to the swim platform of the marine craft.
Figure 2:
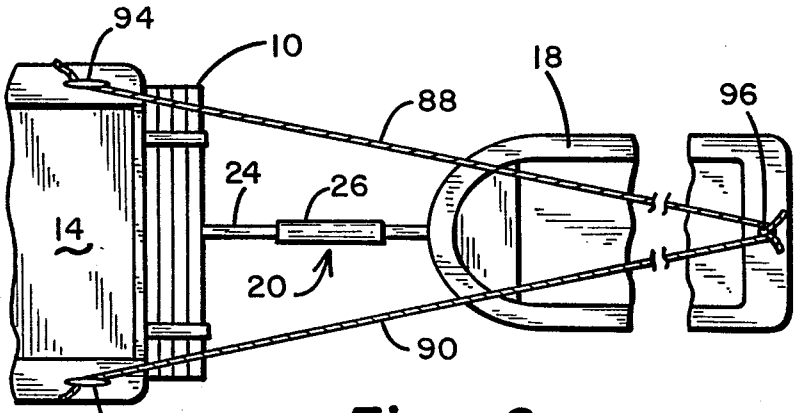
FIG. 2 is a top or plan view of the towing and towed craft of FIG. 1.

Referring to FIGS. 1 and 2, there is shown the stern portion of a relatively large marine craft 14 such as a cruiser or a houseboat and having a swim platform 10 extending generally horizontally from the transom 12 thereof. The swim platform 10 is conventionally located just above the water line 16. The smaller, towed craft is identified by numeral 18 and, as previously indicated, may comprise a small, solid hull boat, an inflatable watercraft or any one of a variety of motor-powered water toys. Joining the towed craft to the towing craft is the tow bar assembly of the present invention. It is indicated generally by numeral 20 and comprises a tow bar socket member 22, the tow bar 24 itself, a floatation member 26 and a connector 28 adapted to couple with a bow tie point, here shown as a conventional bow eye 30 found affixed to the bow of most marine craft.

Figure 3:
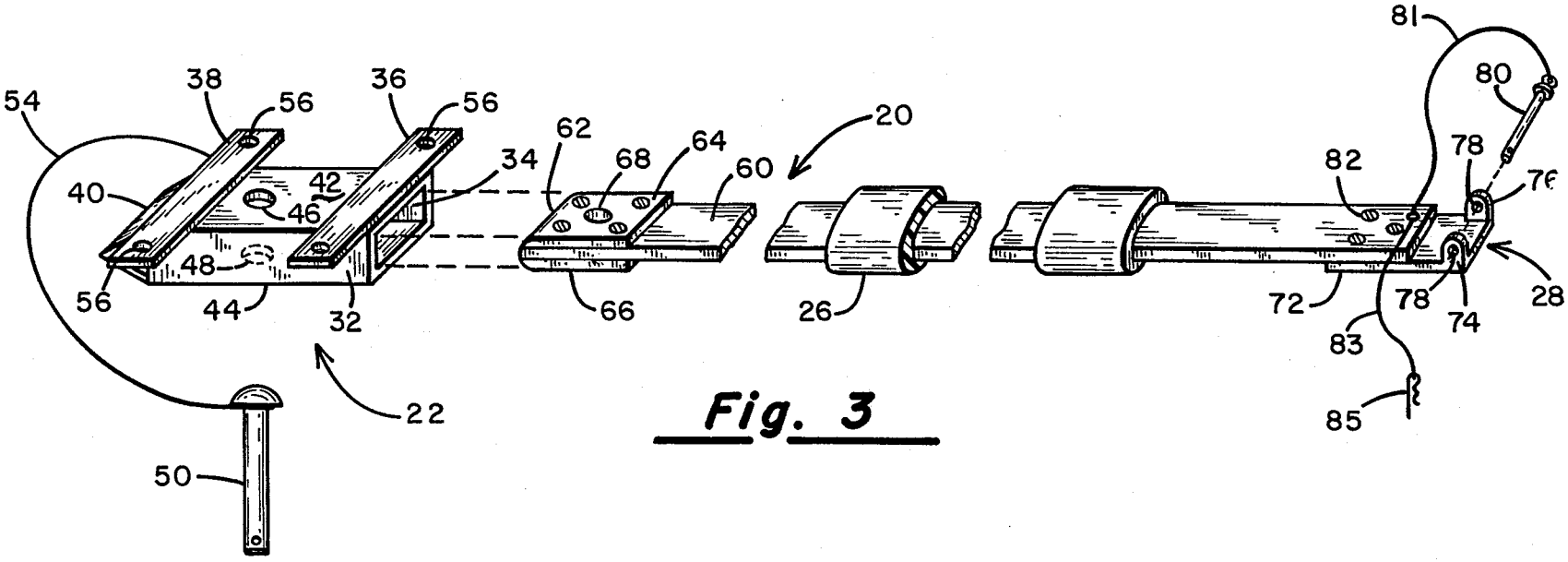
FIG. 3 is a blown-apart view of the tow bar assembly of the present invention.

Referring next to FIG. 3 there is shown a blown-apart view of the tow bar assembly of the present invention. The tow bar socket 22 is seen to comprise a tubular member 32 of generally rectangular (square) cross-section having a tow bar receiving opening 34 in a first end thereof and first and second mounting flanges 36 and 38 welded or otherwise attached to the exterior surface of the tubular channel 32. An angle member 40 is welded in place across the other open end of the tubular channel 32 and functions as a stop or locator as will be subsequently described.

The rectangular tube 32, the mounting flanges 36 and 38 and the angle member 40 are preferably fabricated from a material that will not rust or corrode in the water environment in which it is used. Typically, stainless steel, anodized aluminum or bronze may be used. It is also contemplated that the socket member 22 can be fabricated from cold rolled steel and treated to impede rust and corrosion.

Formed vertically through the bottom wall 44 and the top wall 42 of the towing socket 22 are a pair of aligned apertures 46 and 48 into which a latch pin 50 may be inserted. To prevent inadvertent loss of the latch pin 50, it is found convenient to connect it to the socket member 22 by means of a tethering cord, chain or cable 54.

As shown in FIG. 1, the socket assembly 22 is bolted to the underside of the swim platform by four bolts passing through holes drilled in the swim platform and through the holes 56 formed through the mounting flanges 36 and 38. Where the swim platform 10 has a downwardly projecting trailing edge or rim, shims, as at 58, may be inserted between the upper surface of the socket member 22 and the underside of the swim platform so that the socket opening 34 will be below the level of the downwardly projecting swim platform rim.

With continued reference to FIG. 3, the tow bar 20 is seen to comprise an elongated rectangular bar 60 whose width dimension is only slightly less than the width of the opening 34 in the socket member 22. With no limitation intended, the bar member 60 is preferably formed from fiberglass and has an overall length of approximately 4 feet. It may be, for example, 2 inches wide and ½ inch in thickness. While fiberglass is recommended, it has also been found that an anodized aluminum bar is suitable, especially for fresh water use.

Bolted or otherwise affixed to the forward end portion 62 of the bar 60 are a pair of reinforcing plates 64 and 66 which sandwich the forward end of the bar. A pin receiving aperture 68 is drilled completely through the reinforcing plates and bar at a location such that when the bar 20 is inserted into the socket 22, the rounded forward end 62 of the bar assembly engages the apex of the stop member 40 when the pin receiving holes 46, 68 and 48 are vertically aligned.

Surrounding the shank portion of the bar 60 is a floatation device 26, here shown as a tube of closed-cell foam. The buoyancy provided by the foam is sufficient to prevent the bar assembly 20 from sinking if it should be inadvertently dropped. It also keeps the tow bar 20 at the surface when its rear end is joined to the bow eye 30 of the towed craft but the front end has not, as yet, been inserted into the tow bar socket 22.

Bolted to the other end of the bar 60 is a clevis connection 28 comprising a forged metal strap 72 having perpendicularly projecting ears 74 and 76, each with a bore 78 formed therethrough through which a clevis pin 80 may be inserted. The member 28 is bolted to one side of the bar 60 by flathead bolts as at 82. A tether 81 secures the clevis pin 80 to the tow bar to prevent its accidental loss. Similarly, the tether 83 prevents loss of the clevis pin retainer 85.

Figure 4:
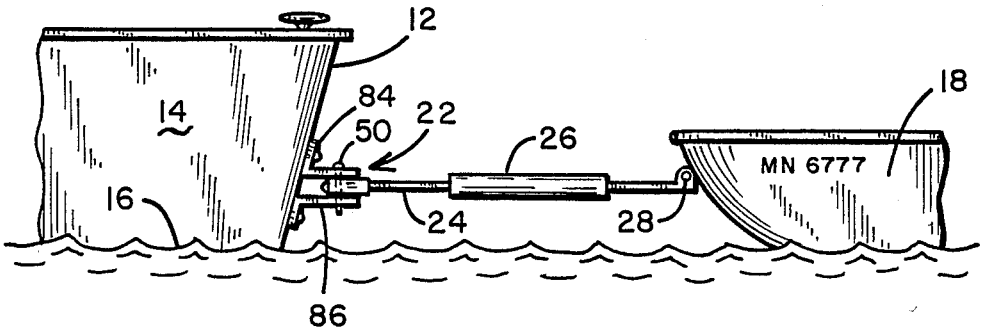
FIG. 4 is a partial side elevation view showing the manner in which the tow bar socket assembly can be attached to the transom of towing craft not equipped with a swim platform.
Figure 5:
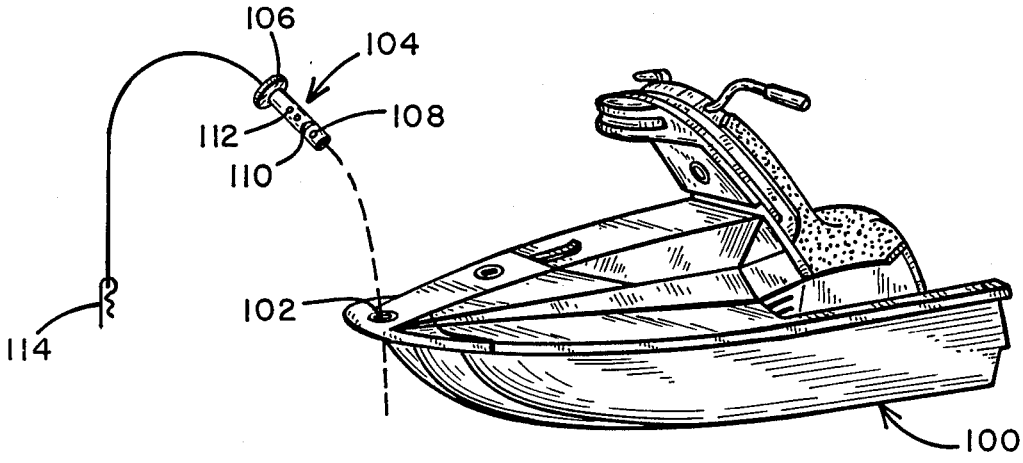

FIG. 4 illustrates the manner in which the tow bar assembly of the present invention can be adapted to a towing marine craft which does not employ a swim platform. Here, a pair of angle brackets 84 and 86 welded or otherwise affixed to the tubular socket member 32 are bolted to the transom 12. As can be seen, the uppermost bracket 84 is bent at a slightly acute angle whereas the lower bracket member 86 is bent at an obtuse angle. This accommodates the generally sloping profile of the transom and maintains the tow bar socket 22 in a generally horizontal disposition. Where the towed craft does not include a conventional bow eye as at 30 in FIG. 1 but instead, as in the case of a personal watercraft having a bow tie point comprising a through-hole as at 102 in FIG. 5, a special pin 104 may be used to provide purchase of the tow bar's clevis 28. Pin 104 has an enlarged head 106 preventing it from passing through the through-hole 102 and a flat shank portion 110 with an aperture 108 for receiving the clevis pin 80 therethrough. Plural holes 112 are intended to receive a retainer spring clip 114 for holding pin 104 securely in the bow through-hole 102.

In use, when it is desired to couple a small auxiliary watercraft to the rear of a larger towing craft, the operator will first couple the tow bar 20 to the bow eye of the craft to be towed by inserting the bow eye between the ears 76 and 78 and inserting the pin 80 through the aligned apertures. A retainer clip passing through the pin holds it in place. Next, he or she will maneuver the auxiliary craft 18 to the rear of the larger towing craft 14 and while standing on the swim platform 10, will reach down and grasp the tow bar 20 which, at this time, will be floating on the surface of the water due to the floatation device 26. By inserting the end 62 of the tow bar 60 into the opening 34 in the socket 22 and forcing the rounded tip member 62 to the limits set by the angle member 40, the aperture 68 in the tow bar will be vertically aligned with the apertures 46 and 48 formed in the socket, allowing the pin 50 to be dropped through a hole drilled in the swim platform and through the aforementioned aligned holes. The latch pin 50 preferably has a carriage bolt head to provide a smooth profile on the upper surface of the swim platform.

To avoid excessive lateral strain on the tow bar and hold the towed craft in alignment, it is also found convenient to employ lines, such as 88 and 90 in FIG. 2, which extend between cleats 92 and 94 on the aft portion of the towing craft and a fixation point 96 located at the stern of the towed craft. Prior to coupling the auxiliary craft to the towing craft, these ropes would generally be tied at the fixation point 96 and extended up to the bow portion of the towed craft 18. Once the tow bar is coupled in place, it is easy for the operator to reach from the swim platform to the front of the towed craft to grab the coiled lines and bring them on board the towing craft to tie them off on the cleats 92 and 94.

Because the tow bar 60 is made from an incompressible material, during use there is no shortening or lengthening thereof. However, the material from which the bar member 60 is fabricated possesses sufficient flexibility in a vertical plane, allowing it to bend as the towed craft rises and falls on waves or wake that may be present. Because the width dimension of the bar 60 is only slightly less than the width of the socket opening 34, transverse motion of the towed craft is constrained while controlled vertical motion is permitted. Lines 88 and 90 may also be employed where the length of the towed craft might otherwise cause undue transverse stress on the tow bar. Because the tow bar assembly rigidly couples the two craft together, the towing craft can back up, turn, etc., without fear of fouling the lines.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Apparatus for coupling a relatively small auxiliary watercraft to the stern of a larger towing vessel, said auxiliary watercraft having tie point means at its bow, said vessel including a stern transom, comprising in combination:

(a) a tubular socket attachable to said transom, said socket having a latch pin-receiving aperture passing therethrough;

(b) an elongated, longitudinally incompressible but vertically resilient bar member of a predetermined length and having a latch pin-receiving aperture on a first end thereof and a coupling means connected to a second end thereof for mating with said bow tie point means, said bar member exhibiting a predetermined spring constant and said first end being insertable into said tubular socket for constraining rotation of said bar member about a vertical axis; and (c) a coupling pin insertable through said pin-receiving aperture of said socket and said bar member when aligned.

2. The apparatus as in claim 1 wherein said bar member is made of fiberglass.

3. The apparatus as in claim 1 wherein said bar member is made of a tempered aluminum.

4. The apparatus as in claims 1, 2 or 3 wherein said bar member is sufficiently resilient in a vertical plane to allow said auxiliary watercraft to rise and fall under influence of wave action while being towed.

5. The apparatus as in claim 1 and further including floatation means secured to said bar member.

6. The apparatus as in claim 5 wherein said floatation means comprises a sleeve of a closed foam material surrounding a portion of said bar member.

7. The apparatus as in claim 1 and further including bracket means attached to said tubular socket for facilitating attachment of said tubular socket to said transom or swim platform.

8. A tow bar assembly for coupling a small, auxiliary watercraft to the transom of a relatively larger boat with said auxiliary watercraft having a bow tie point proximate a leading edge surface of said watercraft, comprising:

(a) a tubular socket means having a rectangular cross-section of a predetermined width and height dimension attachable to the transom and having a vertical, pin-receiving bore extending therethrough;

(b) an elongated, longitudinally incompressible, rectangular cross-section bar member having first and second end portions, said first end portion dimensioned to fit within said tubular socket means and including a pin-receiving bore alignable with said pin-receiving bore passing through said socket means, said bar member being flexible in a vertical plane when inserted in said tubular socket means, said second end portion including means for securing said second end portion to said tie point of said auxiliary watercraft.

9. The tow bar assembly as in claim 8 and further including a pin member attached to said tubular socket means by tethering means of a length sufficient to allow insertion of said pin member through said pin-receiving bore in said socket means and in said first end portion of said bar member when the two are vertically aligned.

10. Apparatus for coupling a relatively small auxiliary watercraft to the stern of a larger towing vessel, said auxiliary watercraft having tie point means at its bow, said vessel including a stern transom with a swim platform extending horizontally from said transom immediately above the water line, comprising in combination:

(a) a tubular socket attachable to said swim platform, said socket having a latch pin-receiving aperture passing therethrough;

(b) an elongated, longitudinally incompressible but vertically resilient bar member of a predetermined length and having a latch pin-receiving aperture on a first end thereof and a coupling means connected to a second end thereof for mating with said bow tie point means, said bar member exhibiting a predetermined spring constant and said first end being insertable into said tubular socket for constraining rotation of said bar member about a vertical axis; and (c) a coupling pin insertable through said pin-receiving aperture of said socket and said bar member when aligned.

11. The apparatus as in claim 10 wherein said bar member is made of fiberglass.

12. The apparatus as in claim 10 wherein said bar member is made of a tempered aluminum.

13. The apparatus as in claims 10, 11 or 12 wherein said bar member is sufficiently resilient in a vertical plane to allow said auxiliary watercraft to rise and fall under influence of wave action while being towed.

14. The apparatus as in claim 10 and further including floatation means secured to said bar member.

15. The apparatus as in claim 14 wherein said floatation means comprises a sleeve of a closed foam material surrounding a portion of said bar member.

16. The apparatus as in claim 10 and further including bracket means attached to said tubular socket for facilitating attachment of said tubular socket to said transom or swim platform.

17. A tow bar assembly for coupling a small, auxiliary watercraft to the swim platform of a relatively larger boat with said auxiliary watercraft having a bow tie point proximate a leading edge surface of said watercraft, comprising:

(a) a tubular socket means having a rectangular cross-section of a predetermined width and height dimension attachable to the underside of the swim platform of said boat and having a vertical, pin-receiving bore extending therethrough;

(b) an elongated, longitudinally incompressible, rectangular cross-section bar member having first and second end portions, said first end portion dimensioned to fit within said tubular socket means and including a pin-receiving bore alignable with said pin-receiving bore passing through said socket means, said bar member being flexible in a vertical plane when inserted in said tubular socket means, said second end portion including means for securing said second end portion to said tie point of said auxiliary watercraft.

18. The tow bar assembly as in claim 17 and further including a pin member attached to said tubular socket means by tethering means of a length sufficient to allow insertion of said pin member through said pin-receiving bore in said socket means and in said first end portion of said bar member when the two are vertically aligned.

* * * * *